US006840859B2

(12) United States Patent
Cannon et al.

(10) Patent No.: US 6,840,859 B2
(45) Date of Patent: Jan. 11, 2005

(54) METHOD AND APPARATUS FOR MAPPING INFORMATION FROM MULTIPLE SOURCES ONTO A SINGLE IMAGE

(75) Inventors: Lee E. Cannon, Bozeman, MT (US); Danny W. Bilyeu, Bozeman, MT (US)

(73) Assignee: IGT, Reno, NV (US)

( * ) Notice: Subject to any disclaimer, the term of this patent is extended or adjusted under 35 U.S.C. 154(b) by 23 days.

(21) Appl. No.: 10/027,808

(22) Filed: Dec. 19, 2001

(65) Prior Publication Data

US 2003/0114222 A1 Jun. 19, 2003

(51) Int. Cl.[7] ..... A63F 9/24
(52) U.S. Cl. ..... 463/30; 463/37
(58) Field of Search ..... 413/16–22, 29, 413/30, 31, 37; 273/138.1, 274, 269, 139

(56) References Cited

U.S. PATENT DOCUMENTS 5,885,158 A 3/1999 Torango et al.
5,947,820 A 9/1999 Morro et a.
6,234,899 B1 * 5/2001 Nulph ..... 463/25
6,368,213 B1 * 4/2002 McNabola ..... 463/18
6,406,023 B1 6/2002 Rowe

* cited by examiner

*Primary Examiner*—Kim Nguyen
(74) *Attorney, Agent, or Firm*—Marshall, Gerstein & Borun LLP

(57) ABSTRACT

A method and apparatus for mapping multiple game entries in a single gaming event. Individual gaming spaces, each representing an outcome associated with play of a game, are divided into selection spaces. Each gaming space includes an equal number of associated selection spaces. The selection spaces are in substantially the same relative locations throughout each of the gaming spaces and each selection space in the same relative location within each gaming space comprises one of a set of selection spaces to enable one entry to the gaming event. Paper and video apparatus embodiments are disclosed.

29 Claims, 8 Drawing Sheets

METHOD AND APPARATUS FOR MAPPING INFORMATION FROM MULTIPLE SOURCES ONTO A SINGLE IMAGE

FIELD OF THE INVENTION

The present invention relates to a method and apparatus for mapping information from multiple sources onto a single image and more particularly relates to a method for displaying individual entries in a gaming event as indicia having a common location within a larger gaming space on a game entry.

BACKGROUND OF THE INVENTION

Gaming establishments have proliferated in recent years, causing increased competition for new customers. Casinos must provide entertaining and exciting games to retain existing customers and attract new customers. This task becomes increasingly difficult as games are widely available for players. One method to combat boredom with games is to allow players to make multiple entries into a single gaming event. Multiple entries give a player additional opportunities to win an event, as well as allowing a player to select multiple favorite or "lucky" entries.

Players often make multiple entries into games like Keno and lotteries using multiple game cards requiring a player to possess many gaming skills. Not only must a player make entries on a multitude of cards, but also keep track of each card to determine if there is a winner among any of the entries. Keeping track of all these separate entries becomes difficult and burdensome. This discourages a player from making multiple entries, which affects the entertainment value of the game and may diminish gaming revenues for the player. In addition, requiring a player to deal with multiple, separate game cards to effect multiple entries slows down the rate of game play as it takes an undesirable period of time to set up for each game. The same problem is present in gaming using video displays, where a number of "game cards" or other images representing multiple entries in a gaming event are displayed. Sometimes the video displays depict the multiple entries in a matrix wherein each entry is displayed separately, while other times the entries are perceptibly "stacked" over one another and a player must cause each entry other than the foremost to "pop up" from behind the others to be fully viewed.

What is needed is a method and apparatus for a game so that a player may make multiple entries into a single game without using multiple entry forms or manipulating partially hidden images on a video display.

BRIEF SUMMARY OF THE INVENTION

The present invention includes a method and apparatus for graphically mapping information from multiple sources onto a single image. The present invention is directed to any game or gaming machine where players often want, or may be incentivized, to make multiple entries into a single gaming event. In the present invention, rather than making multiple separate entries, a player need only complete a single entry form or interact with a single entry form image on a video display screen to obtain multiple opportunities for winning a single gaming event. The present invention may be used in conjunction with games such as Keno, lotteries, and any game that uses the same, or a common, base entry or game card form or format.

Further, the present invention may be used in conjunction with any suitable type video display. Where a conventional video display with a standard sized, relatively small screen is only able to display a limited number of game cards with clarity, the present invention includes the compaction of data onto a single entry, making it easier to display information on a video display screen with limited display area. The present invention efficiently uses screen display area for allowing multiple game entries to be easily visualized on a standard sized screen of a conventional video display that would otherwise require a significantly larger display area, thus saving considerable capital cost of a larger video display and allowing casino floor space to be conserved. Consequently, the present invention not only has application to paper forms but is also applicable to electronic gaming and video displays, including any gaming event which is played over a network of gaming machines.

By enabling a player to focus his or her attention on a single game card or image to monitor a number of entries rather than looking at multiple game cards or multiple images distributed across a video display, monitoring of game play by the player is greatly facilitated by the present invention.

The present invention makes games such as Keno and lotteries and other games using forms more entertaining for a game without the burden of filling out and tracking multiple forms.

As used herein, the terms "game, "gaming" or "game of chance" includes and encompasses not only games having a random or arbitrary outcome, but also such games which also invite or require some player input to the game having at least the potential for affecting a game outcome. Such player input is generally termed "skill" whether or not such input is in actuality beneficial in terms of game outcome.

DETAILED DESCRIPTION OF THE INVENTION

In the past, to make multiple entries into a game such as Keno or a lottery game, a separate card would be required for each entry. With the present invention, however, one entry form may be used to make multiple gaming entries into a single gaming event. The present invention may be utilized in conjunction with any gaming entry form having a standard format.

Figure 1:
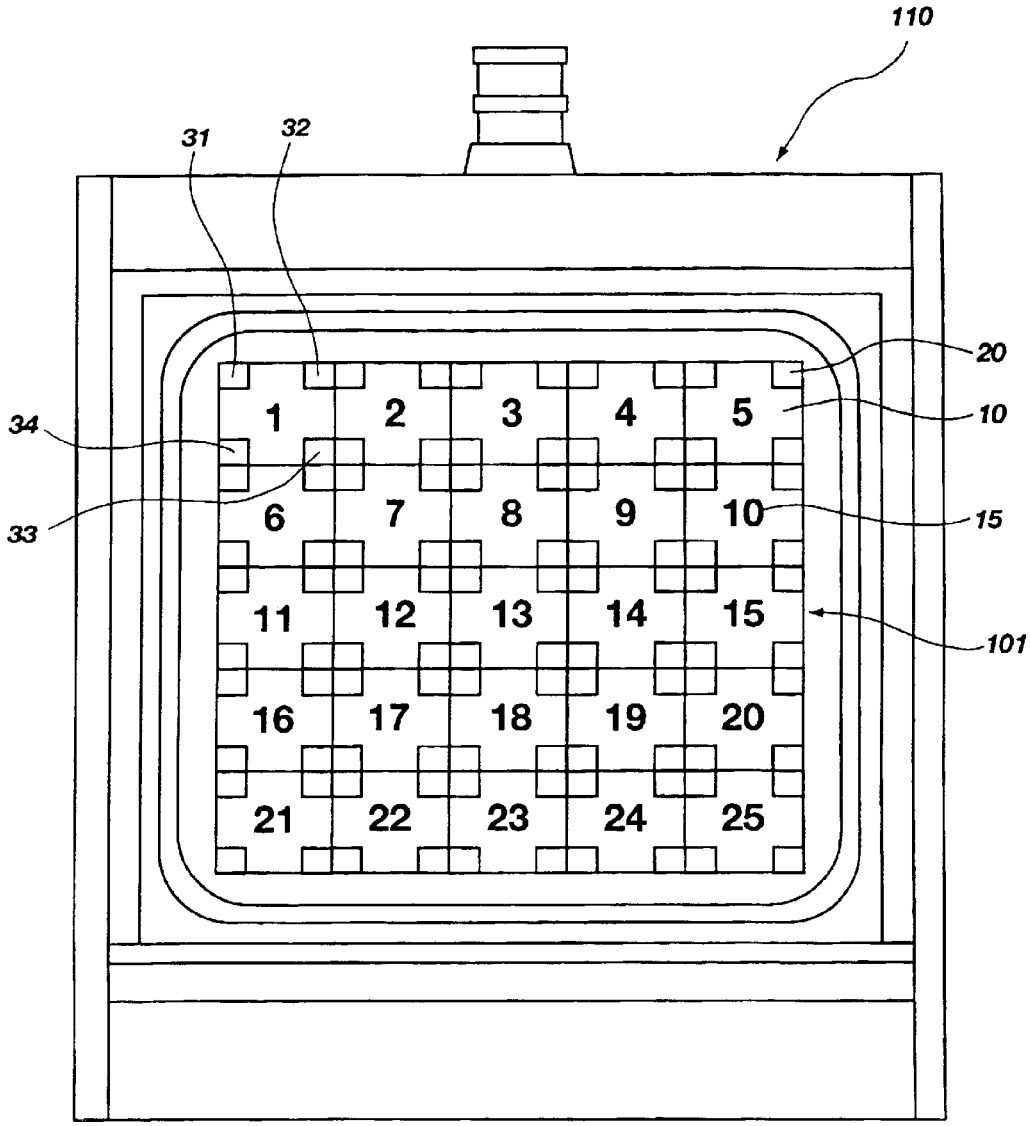
FIG. 1 depicts an entry form image format according to the present invention in conjunction with a Keno game before the form has been marked.

The method of the present invention is depicted in drawing FIG. 1 in conjunction with a Keno game. It should be noted that each of FIGS. 1 through 5 represents a greatly simplified Keno game card or game card image employing only twenty-five numbers instead of the eighty numbers conventionally employed in Keno play. The Keno game is shown displayed on an exemplary, conventional casino video gaming machine 110 and the illustration also depicts the form of a game card which may be used to mark in a conventional Keno game wherein numbers are selected on paper stock. The game form image 101 as displayed on the video screen of gaming machine 110 has a gaming space 10, also termed a cell, for each possible gaming outcome. The gaming outcomes are typically numbers for games such as lotteries and Keno, but can also be any other indicia or symbol for designating a potential outcome. Each gaming space 10 has a gaming space indicator 15 in the form of an identifier so as to correspond each gaming space 10 to a particular outcome and each gaming space 10 includes a plurality of associated selection spaces 20. The geometrical orientation and locations of the selection spaces 20 within the gaming space 10 distinguishes separate game entries. The total number of selection spaces 20 in a gaming space 10 represents the total number of potential separate entries that may be made into a single gaming event using the game form 101.

For example, as shown in drawing FIG. 1, in a gaming space 10 there may be an upper left selection space 31, an upper right selection space 32, a lower right selection space 33, and a lower left selection space 34. Each of these selection spaces in the game form corresponds to one of four different entries to the Keno game (entries 1, 2, 3, and 4 respectively).

Although there are no limits to the number of entries that can be made from a single game form, the practicality of the matter is that the selection spaces 20 may be most effective when spaced apart as with the corners of a rectangular, specifically square, gaming space 10 acting as locations for selection spaces 20. The selection spaces 20 may be configured as desired, and any suitable geometric or other shape may be employed. In the embodiment of the present invention shown in drawing FIG. 1 the selection spaces 20 are rectangles, and specifically squares. The selection spaces 20, however, may be any other shape including triangular, circular, etc. Likewise, the gaming spaces 10 themselves may be of any desired geometry.

Figure 4:
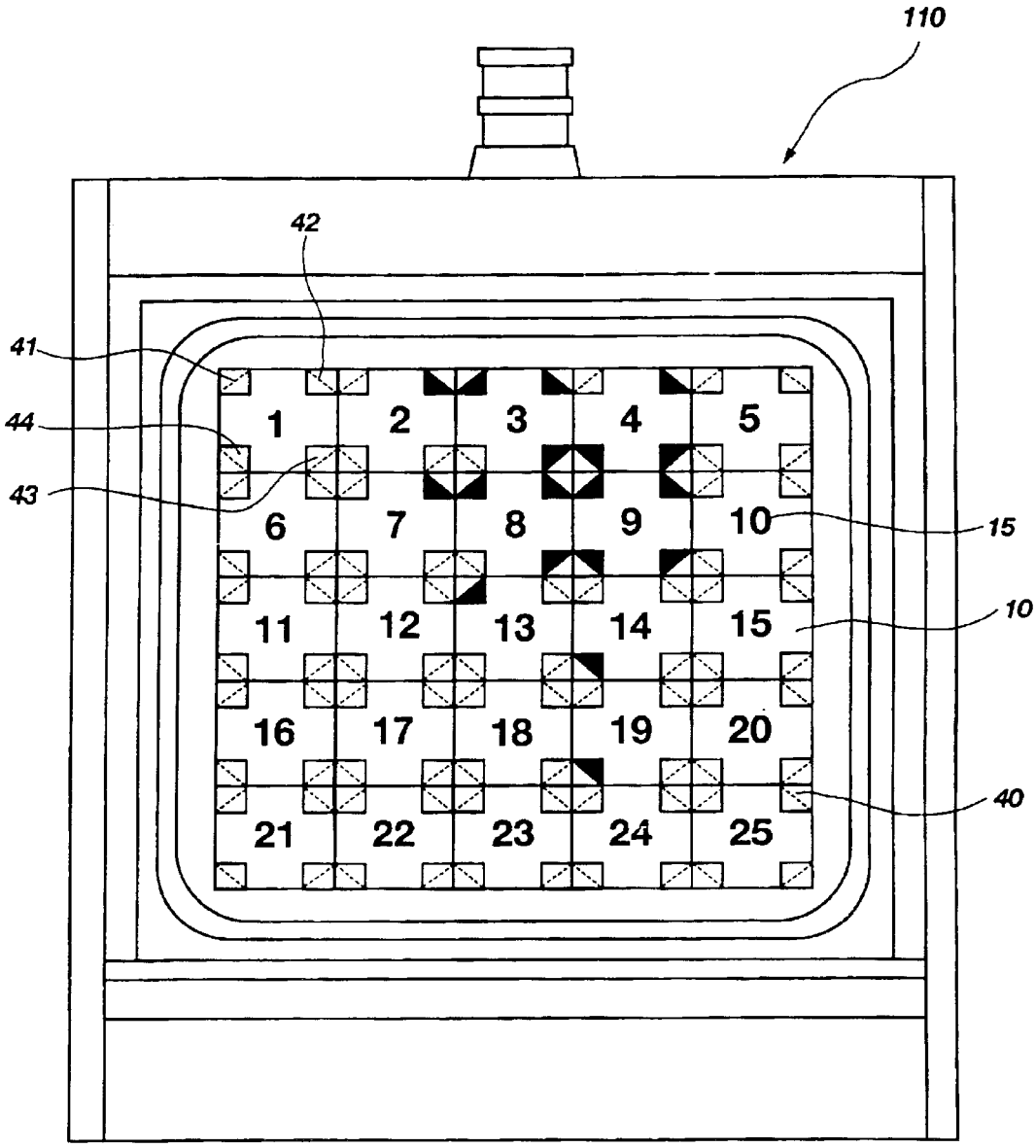
FIG. 4 depicts another arrangement and shape of the selection spaces in the present invention in conjunction with a Keno game with certain selected spaces marked.

Illustrated in drawing FIG. 4 is another exemplary arrangement and shape of the selection spaces 20. Rather than using square selection spaces (See FIG. 1), triangular selection spaces 41, 42, 43, 44 may be used. Triangular selection spaces 41, 42, 43, 44 are not only easier to distinguish from neighboring selection spaces 41, 42, 43, 44 in an adjacent gaming space 10 but the selection spaces actually point to or face the selected gaming space indicia 15.

Figure 5:
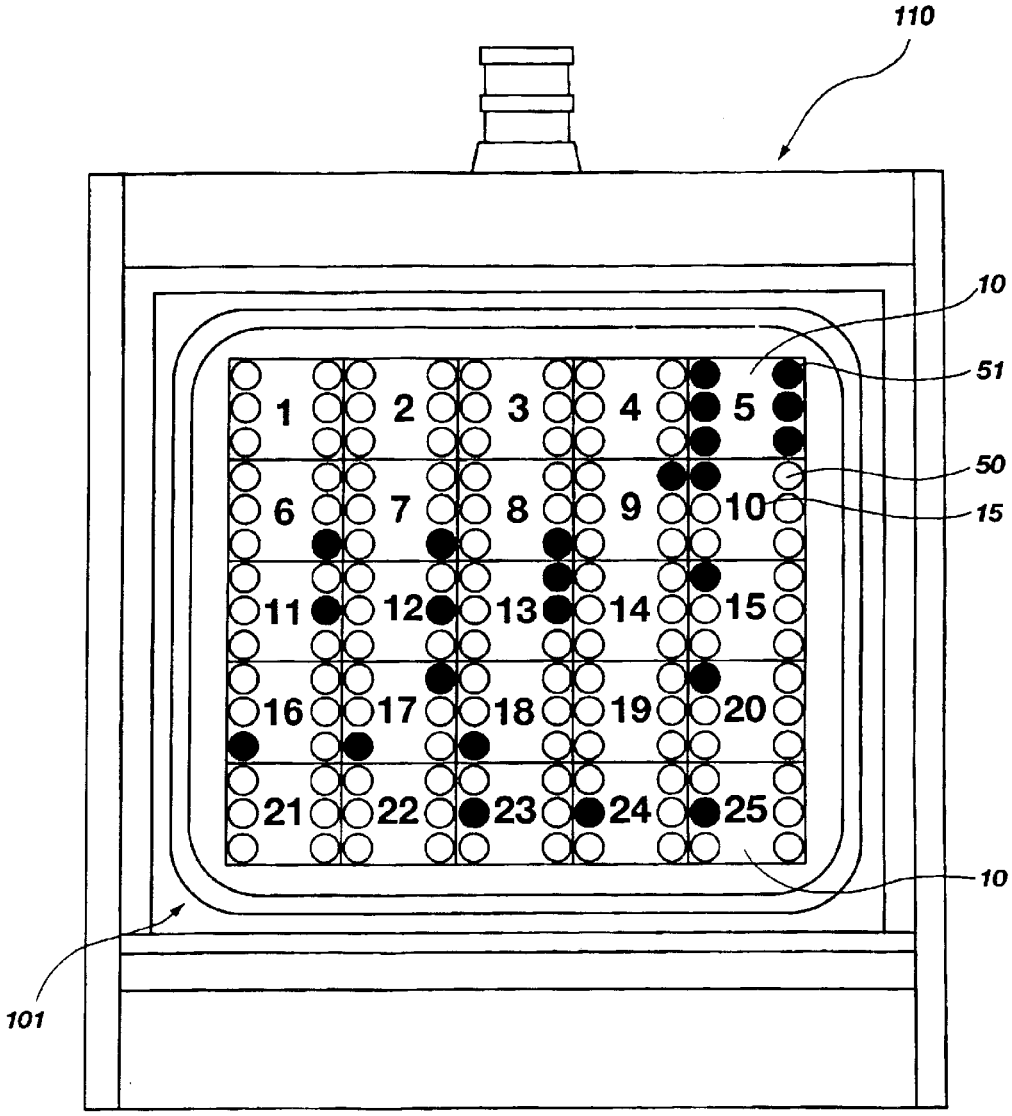
FIG. 5 depicts a further arrangement and shape of the selection spaces in the present invention in conjunction with a Keno game with certain selected spaces marked.

Illustrated in drawing FIG. 5 is yet another selection space arrangement and shape. In this case, the familiar machine-readable circle is shown as a circular selection space 50. It should be noted that in this embodiment there are six selection spaces 50 associated with each gaming space 10, rather than four. These selection spaces 50 offer the advantage that they are easy to fill in to create selected spaces 51 and are easily readable using conventional optical scanning machines. While illustrated in the context of a gaming machine video display image, this embodiment is particularly well suited for lottery tickets and other gaming cards that will be scanned by a machine and the screen image depicted in FIG. 5 is illustrative of an exemplary lottery ticket or game card format.

Figure 2:
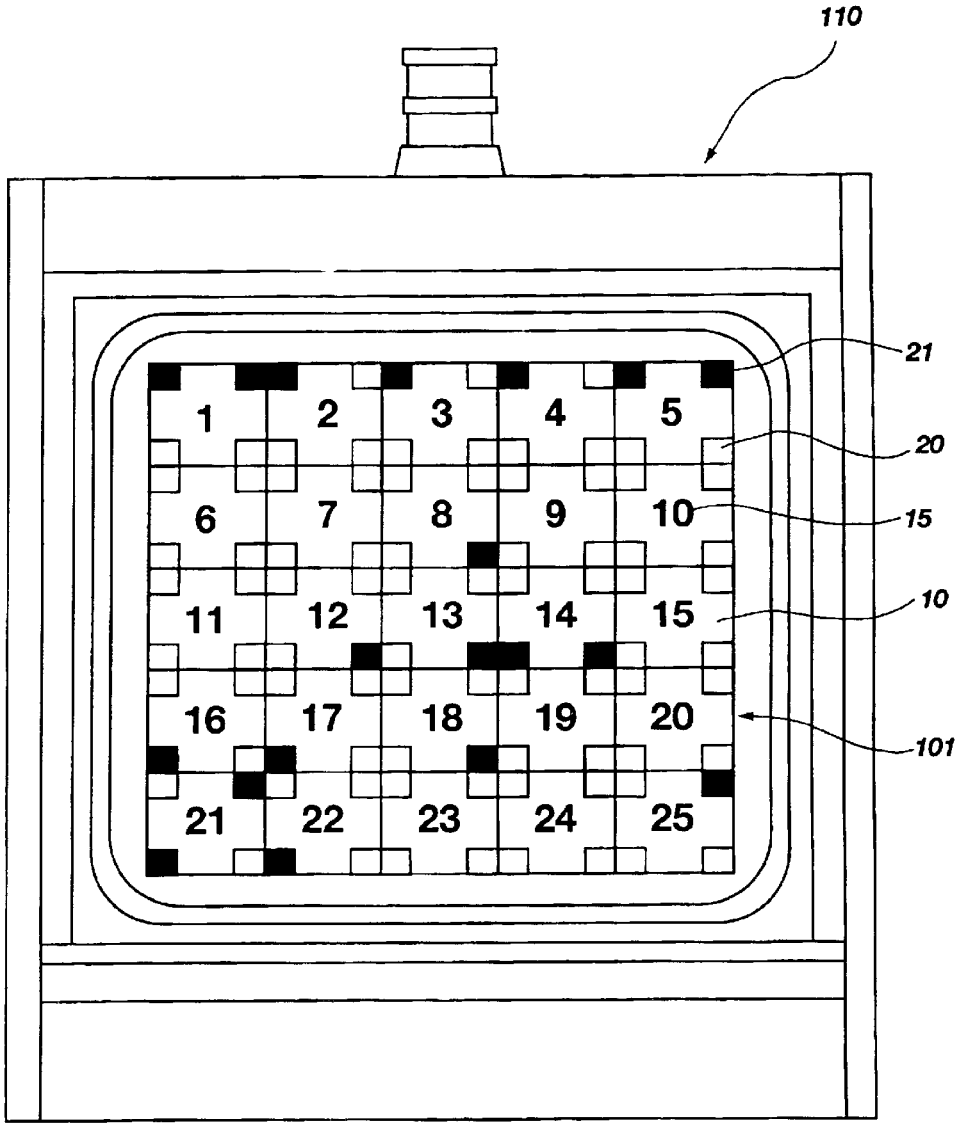
FIG. 2 depicts the entry form image format of FIG. 1 in conjunction with a Keno game after selected spaces are marked by a player.

Selection spaces 20 are most easily selected by shading (or filling) in the selection space 20 as shown in drawing FIG. 2 to create a selected space 21. The selection of a selection space 20 may also be termed altering a selection space 20 to include an information element. Other indicia may be used to indicate a selected space 21. For example, a selection space 20 may be punched out of the card stock of a game card or other game entry form to create a selected space 21 and provide a permanent record of the gaming space 10 selection and game entry. The embodiment of FIG. 5 employing circular selection spaces 50 may be especially suitable for implementing this approach. Alternately, any marking in the selection space 20 may be used to indicate that the player has chosen a gaming space 10. The advantage of shading in the selection space 20 is that it is much easier to read the game entry form, and to distinguish a marked from an unmarked selection space 20. This is true not only for visibility to the players, but also for optical scanning equipment that may be used to input the game entry into a computerized system, as in the case of a lottery ticket.

Illustrated in drawing FIG. 2 is a game entry form image 101 as displayed on the video screen of video gaming machine 110 as marked by a player who has selected picks on four different entries. Entry 1 is a 5-spot pick across the top row, selecting numbers 1, 2, 3, 4 and 5 as depicted by the shading of the selection spaces 20 in the upper left corners of each gaming space 10. Entry 2 is a four-spot pick of numbers 1, 5, 21, and 25 as depicted by the shading in the upper right corners of the associated gaming spaces 10. Entry 3 is a 5-spot pick of numbers 8, 12, 13, 14, and 18 as depicted by the shading of the selection spaces 20 in the lower right corners of the associated gaming spaces 10. Entry 4 is a five spot-pick of numbers 14, 16, 17, 21, and 22 as depicted by the shading of the selection spaces 20 in the lower left corners of associated gaming spaces 10. A touch screen may be used to "shade" or fill in selection spaces 20, or other player input elements such as a key pad, a light pen, a mouse or a joystick (the latter two being used to move a cursor on the display) may be employed.

Figure 3:
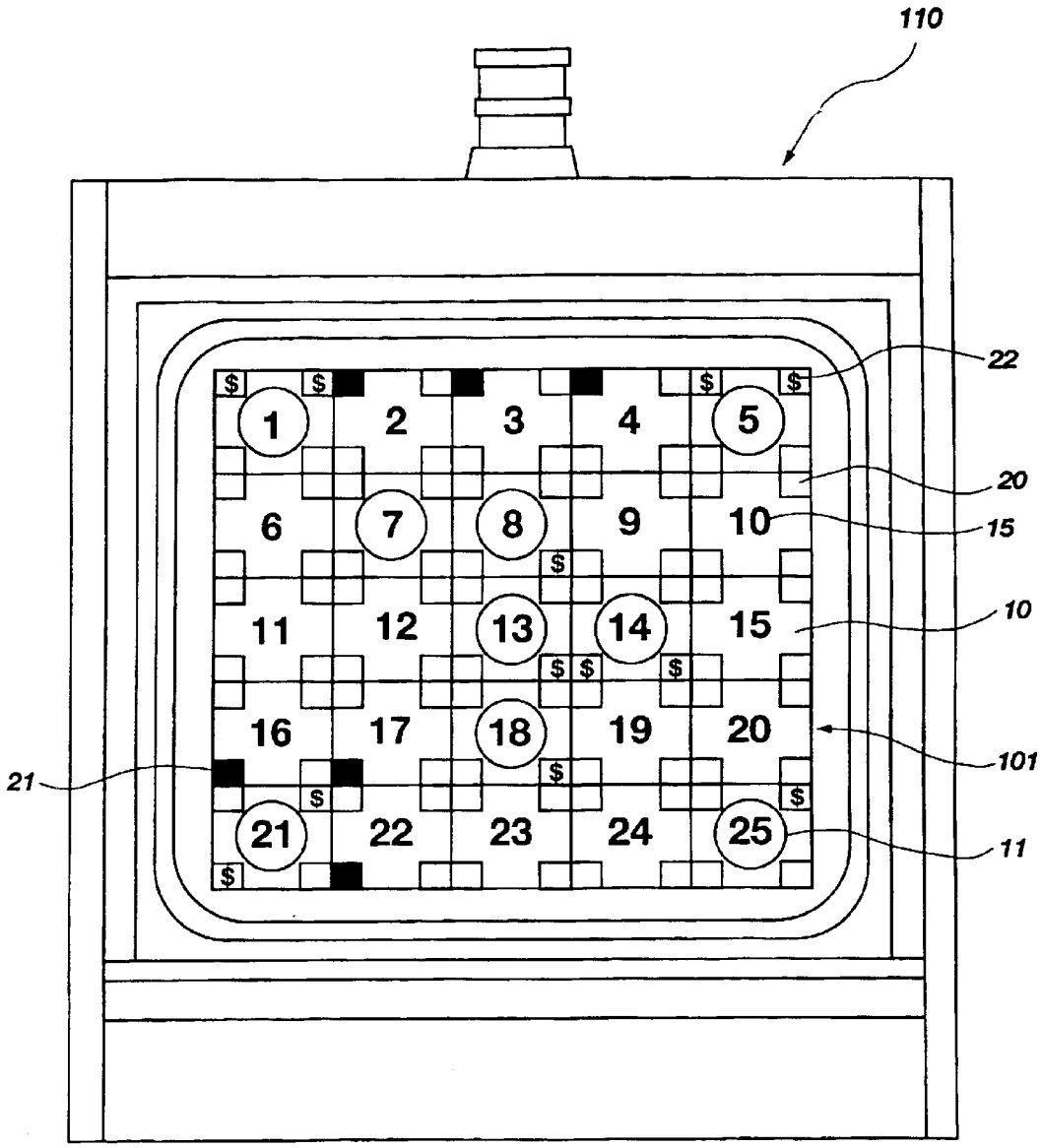
FIG. 3 depicts the entry form image format of FIG. 1 in conjunction with a Keno game after the winning Keno numbers have been selected.
Figure 6:
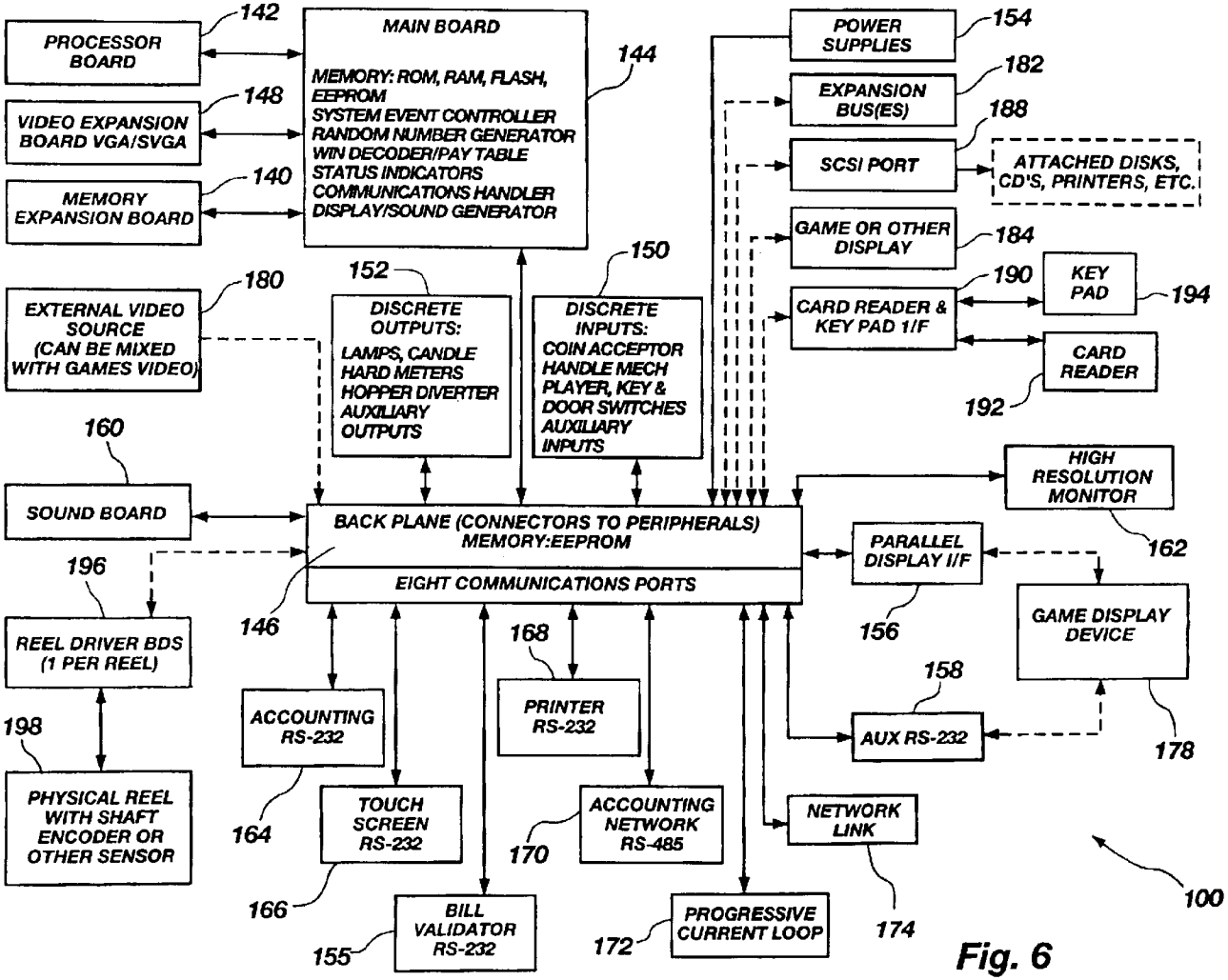
FIG. 6 depicts an internal schematic for an exemplary electronic game machine suitable for adaptation for implementing the present invention.

When the present invention is used in conjunction with an electronic gaming machine and video display, such as schematically depicted in drawing FIG. 6, additional indicia or indicators may be used to indicate a gaming space 10 drawn in the course of game play. For example, when a gaming space 10 is randomly picked or drawn, the corresponding gaming space 10 on a video display of a gaming machine 110 may be annotated with drawn indicia 11. (e.g., circling the selected game space indicator, changing the game space color, or lighting up the game space). Illustrated in drawing FIG. 3 is the effect of drawn game space indicia 11 on the game entry form image 101 on a video screen display of a gaming machine 110. Circling game space indicia 1, 5, 7, 8, 13, 14, 18, 21, and 25 represents the Keno numbers that are drawn.

To further improve the visibility of the winning game spaces, the selected spaces 21 of winning gaming space indicia may be converted on the video screen display and shown as winning indicia 22. Illustrated in drawing FIG. 3 is the use of the winning indicia 22 "$" that may be utilized to replace the shaded selection space 21 of winning gaming spaces 10. Thus, if the gaming space 10 selected by a player has been picked by the game, the selection spaces 20 for that gaming space 10 may be marked with winning indicia or indicators for indicating that the gaming space 10 for that particular game entry has been won. The winning indicia 22 may include color changes or the insertion of a winning symbol. The use of winning indicia 22 is not to be taken as limiting for the purposes of the present invention, but may be used in practice of the invention to provide further contrast to enable a player to more clearly and quickly recognize a winning game entry. The results of the game entry form shown in drawing FIG. 3 are as follows:

Winning number 1 was selected on game entries 1 and 2.

Winning number 5 was selected on game entries 1 and 2.

Winning number 7 was not selected on any game entry.

Winning number 8 was selected on game entry 3.

Winning number 13 was selected on game entry 3.

Winning number 14 was selected on game entries 3 and 4.

Winning number 18 was selected on game entry 3.

Winning number 21 was selected on game entries 2 and 4.

Winning number 25 was selected on game entry 2.

Results of game would be as follows:

Entry 1 (upper left corner)=2 of 5 spots hit (number 1, number 5).

Entry 2 (upper right corner)=4 of 4 spots hit (number 1, number 5, number 21, number 25).

Entry 3 (lower right corner)=4 of 4 spots hit (number 8, number 13, number 14, number 18).

Entry 4 (lower left corner)=2 of 4 spots hit (number 14, number 21).

As may be readily seen from drawing FIG. 3, the present invention provides significantly more information on a relatively small display, ticket or game card area than could be otherwise achieved. The information as presented is clear and unambiguous. Although at first the display may appear to threaten information overload, it is believed that most players would quickly become accustomed to a display according to the present invention. In a video implementation, the display may also include a game summary display area, where a player's statistics, such as number of game squares being played, number of hits, payout, etc., for each game entry may be displayed for the player's further convenience.

The method according to this invention may easily be used on any conventional electronic gaming device or apparatus, such as one shown in drawing FIG. 6. In use and operation, the gaming device 100 includes a memory board 140, a processor board 142, a main board 144 and a back plane 146 integrally or separately formed. Memory expansion board 140 as well as processor board 142 including a graphics system processor and video expansion board VGA/SVGA 148 are operably coupled to the main board 144. The main board 144 preferably includes memory in the form of ROM, RAM, flash memory and EEPROM (electrically erasable programmable read only memory). In addition, the main board 144 includes a system event controller, a random number generator, a win decoder/pay table, status indicators, a communications handler and a display/sound generator.

The main board 144 is operably coupled to the back plane 146 which may include additional memory such as in the form of an EEPROM, and connectors to connect to peripherals. Furthermore, the back plane 146 provides a plurality of communication ports for communicating with external peripherals. The back plane 146 provides the coupling between discrete inputs 150 and the processor board 142 and main board 144. Typical examples of elements which provide discrete inputs 150 are coin acceptors, game buttons, mechanical hand levers, key and door switches and other auxiliary inputs. Furthermore, the back plane 146 provides the coupling between discrete outputs 152 and the processor and main board 144. Typically and by way of example only, elements that provide discrete outputs 152 are in the form of lamps, hard meters, hoppers, diverters and other auxiliary outputs.

The back plane 146 also provides connectors for at least one power supply 154 for supplying power for the processor board 142, a parallel display interface (PDI) 156 and a serial (RS-232) interface 158, the latter two enabling coupling to a game display device 178. In addition, the back plane 146 also provides connectors for a soundboard 160 and a high-resolution monitor 162. Furthermore, the back plane 146 includes communication ports for operably coupling and communicating with an accounting network 164, a touch screen 166 (which may also serve as a game display device), a bill validator 155 incorporated in a currency (bill) acceptor, a printer 168, an accounting network 170, a progressive current loop 172 and a network link 174.

The back plane 146 optionally includes connectors for external video sources 180, expansion buses 182, game or other displays 184, an SCSI port 188 and an interface 190 for at least one card reader 192 (debit/credit, player card, etc.) and key pad 194. The back plane 146 may also include means for coupling a plurality of reel driver boards 196 (one per reel) which drive physical game reels 198 with a shaft encoder or other sensor means to the processor 148 and main board 144 if a gaming device 100 is configured for play of a reel-type game. Of course, the reels may be similarly implemented electronically by display as video images, technology for such an approach being well known and widely employed in the art. In such an instance reel driver boards 196 and physical game reels 198 with associated hardware are eliminated and the game outcome generated by the random number generator on main board 144 is directly displayed on a video game display 184 and, optionally, on a separate game device display 178, as known in the art. Other gaming machine configurations for play of different wagering games such as video poker games, video blackjack games, video Keno, video bingo or any other suitable primary games are equally well known in the art. It is presently contemplated that the present invention, when practiced on a gaming machine, will employ a video display.

It will also be understood and appreciated by those of ordinary skill in the art that selected components of gaming device 100 may be duplicated for play of a game or event in accordance with the present invention as a bonus game, in that at least a separate main board with a second random number generator may be employed, with associated peripherals and links thereto, for play of the bonus game. In the conventional situation wherein a game may be implemented as a bonus game in accordance with the present invention, a separate, self-contained gaming device may be operably coupled as a "top box" or otherwise associated with a conventional, existing gaming machine configured for play of a base game. Thus, many of the components illustrated in FIG. 6 and described with respect thereto will be duplicated, including separate software and associated memory for conducting play of the bonus game with associated pay tables for the bonus awards.

Figure 7:
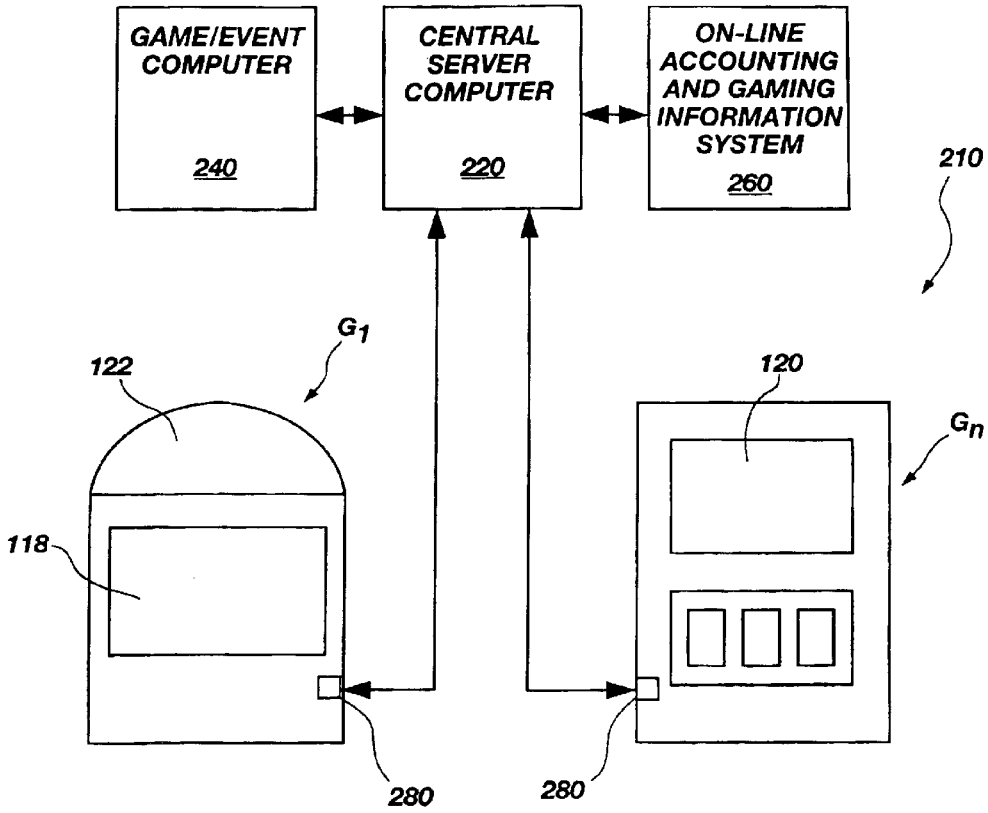
FIG. 7 depicts a schematic for a network of gaming machines suitable for implementing the present invention as a bonus event or otherwise over a network, as in the case of a lottery.

In implementation of the present invention, gaming machines such as gaming machine 110 offering play of a game according to the present invention may be deployed, as schematically depicted in FIG. 7, in a gaming network 210 includes a central server computer 220 operably coupled to a plurality of gaming machine $G_1, G_2 \ldots G_n$. The central server computer 220 automatically interacts with a plurality of gaming machines $G_1, G_2 \ldots G_n$.

Figure 8:
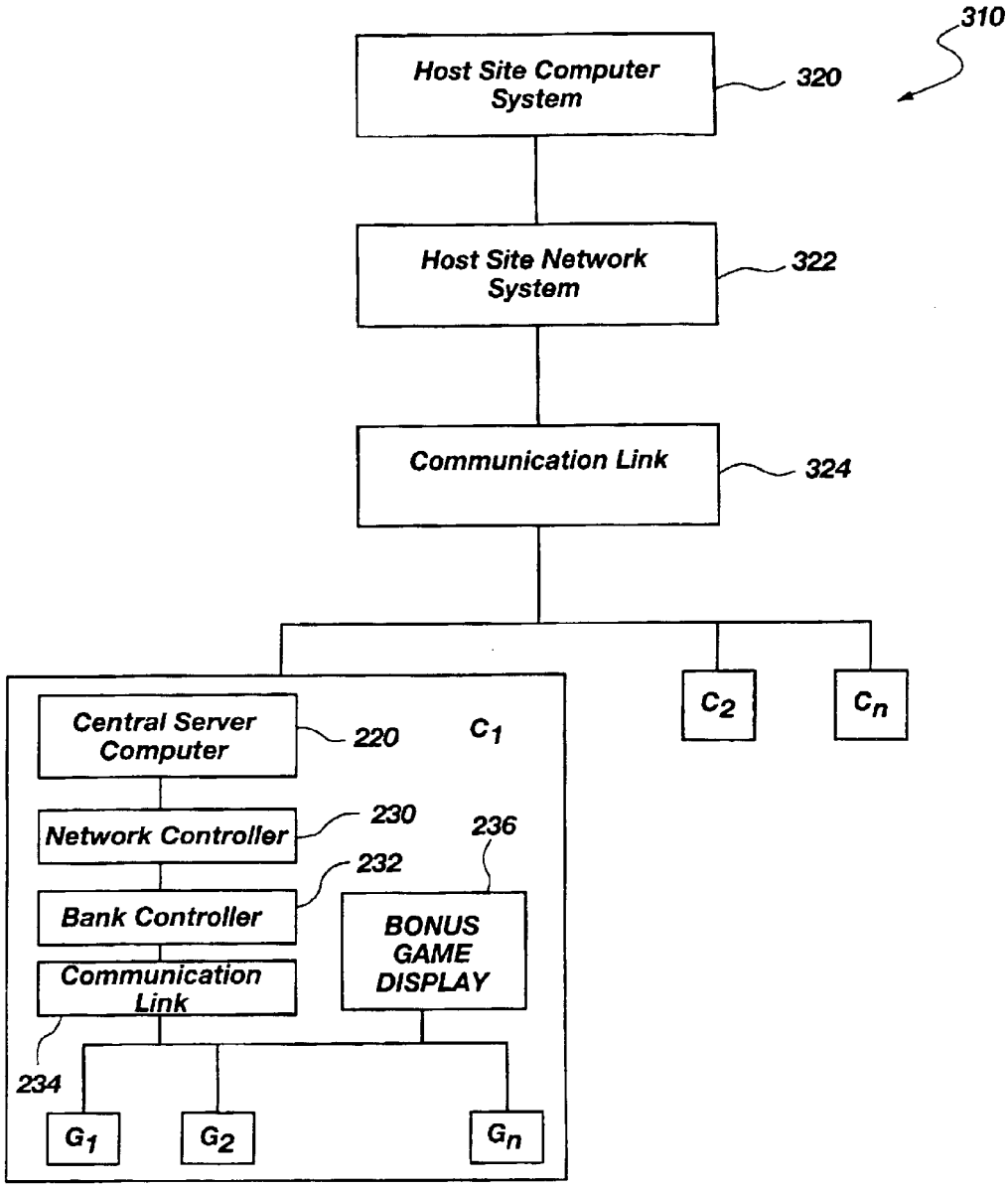
FIG. 8 depicts a gaming system including networked gaming machines located at a plurality of mutually remote sites.

More specifically, and again referring to FIGS. 6 and 7, the gaming network 210 includes a central server computer 220, an event or game computer 240 and a plurality of gaming machines $G_1, G_2 \ldots G_n$. If desired, the functions of central server computer 220 and event or game computer 240 may be combined in a single computer, and at least one separate display 236 associated therewith as indicated in FIG. 8. Each gaming machine $G_1, G_2 \ldots G_n$ includes a controller assembly 280 operably coupled to the central server computer 220 and is comprised of a controller unit designed to facilitate transmission of signals from each individual gaming machine $G_1, G_2 \ldots G_n$ for use by central server computer 220. In addition, the controller assembly 280 includes a network interface board fitted with appropriate electronics for each specific make and model of each individual gaming machine $G_1, G_2 \ldots G_n$.

Referring to FIG. 7, in electronic video games, the central server computer 220 is operably coupled to at least one video game display element 118 as shown at the left hand side of FIG. 7 and sequesters a portion of the video game display element 118 for displaying video attract sequences to attract potential players. Video game display element 118 may be used for display of both the primary and bonus games. Where the gaming network 210 includes reel type game machines $G_1, G_2 \ldots G_n$, as shown at the right hand side of FIG. 7, the central server computer 220 may be operably coupled to at least one active display element 120 so that potential players receive a clear indication of attract sequences and the active display element may be used as a video display for a game implemented in accordance with the present invention. As shown at the left hand side of FIG. 7, the gaming machines $G_1, G_2 \ldots G_n$ may also be provided with a second video display element 122 as an alternative to sequestering a portion of the video game display 118 for displaying video attract sequences and a game. In addition, the central server computer 220 may include sound generating hardware and software for producing attractive sounds orchestrated with the video attract sequences at each of gaming machines $G_1, G_2 \ldots G_n$ if such is not already incorporated therein. The games support input and output between the player and the game for such devices as heads up display, joystick, keyboard, mouse and data glove via interface modules connected through the expansion bus or buses 182 and SCSI port 188.

The attractive multimedia video displays and dynamic sounds may be provided by the central server computer 220 by using multimedia extensions to allow gaming machines $G_1, G_2 \ldots G_n$ to display full-motion video animation with sound to attract players to the machines. During idle periods, the gaming machines $G_1, G_2 \ldots G_n$ preferably display a sequence of attraction messages in sight and sound. The videos may also be used to market specific areas of the casino and may be customized to any informational needs.

Furthermore, the gaming network 210 includes event or game computer 240 operably coupled to the central server computer 220 for scheduling parameters such as the type of game, pay tables and players. The functions of central server computer 220 and event or game computer 240 may, of course, be combined in a single computer. Preferably, the gaming network 210 further includes a real-time or on-line accounting and gaming information system 260 operably coupled to the central server computer 220. The accounting and gaming information system 260 includes a player database for storing player profiles, a player tracking module for tracking players and a pit, cage and credit system for providing automated casino transactions.

As previously noted, a bank or other plurality of gaming machines $G_1, G_2 \ldots G_n$ may be networked together, as known in the art. In addition, and referring to FIG. 8, a host site computer 320 may be coupled to a plurality of the central servers 220 at a variety of mutually remote casinos or other gaming sites $C_1, C_2 \ldots C_n$ for providing a multi-site gaming system 310. Such a system is particularly suitable for use in a lottery-type environment, wherein the gaming machines $G_1, G_2 \ldots G_n$ may comprise remote terminals, accessible either by attendants on behalf of players or directly accessible to players. Gaming system 310 is also suitable for multisite play of casino-type games, including all those previously mentioned.

Preferably, the host site computer 320 will be maintained for the overall operation and control of the gaming system 310. The host site computer 320 includes a computer network 322 and a communication link 324 provided with a high-speed, secure modem link for each individual casino or other gaming site $C_1, C_2 \ldots C_n$.

Each casino or other gaming site $C_1, C_2 \ldots C_n$ includes the central server computer 220 provided with a network controller 230 which includes a high-speed modem operably coupled thereto. Bidirectional communication between the host site computer 320 and each casino site central server 220 is accomplished by the set of modems transferring data over communication link 324.

A network controller 230, a bank controller 232 and a communication link 234 are interposed between each central server 220 and the plurality of attached gaming machines at each casino or other gaming site $C_1, C_2 \ldots C_n$. In addition, the network controller 230, the bank controller 232 and the communication link 234 may optionally be interposed between each central server 220 and a separate display 236 at each casino or other gaming site $C_1, C_2 \ldots C_n$. However, the system 310 may include hardware and software to loop back data for in-machine meter displays to communicate with game or event award insert areas on gaming machines $G_1, G_2 \ldots G_n$.

Gaming machines $G_1, G_2 \ldots G_n$ may be connected to separate display 236 through communication link 234. Communication link 234 may be any of a variety of communication links known in the art, including, but not limited to: twisted-pair wire, coaxial cable, fiber optic, Ethernet, token ring, bus line, Fibre Channel, ATM, standard serial connections, LAN, WAN, Intranet, Internet, radio waves, or other wireless connections.

It will be appreciated to those of ordinary skill in the art that another embodiment may employ some or all gaming machines $G_1, G_2 \ldots G_n$ in the form of personal computers located at sites remote from the host site computer 320. The personal computers may be located in homes, businesses or other locations remote from the host site computer 320, such as a casino site $C_1, C_2 \ldots C_n$. In this embodiment, the personal computers are configured such that the personal computer may connect to host site computer 320 through a network, such as the Internet. The personal computers are enabled to participate in gaming activities by downloading software, wherein the software provides access to the gaming activities and configures the personal computer for play of the gaming activity. The games are preferably conducted and controlled from the host site computer 320.

It is apparent that the present invention provides several features enhancing the play of a game. The present invention simplifies the process for making multiple entries into a single gaming event. The player is enabled to enter more games, more easily, without the burden of filling out multiple entries. With a single entry form, a player has less paperwork to track, and is less likely to lose the entry forms. Further, when the game results are in, it is much easier for a player to determine if he has won. In contrast to shuffling through a number of different entries, the present invention only requires a player to glance at a single form to determine if the game has been won. The present invention makes it easy to enter multiple games, track the progress of each of the games, and determine if any of the entries are winners. Similar advantages obtain when the entry format of the present invention is employed with a video display.

In addition, the present invention enables, by consolidation of a plurality of game cards into a single form, the use of larger gaming spaces or cells for easier viewing than with a plurality of smaller but separate game cards. The larger cell also facilitate implementation of the invention on touch screens of a video display. The single, common viewing area makes for easier tracking and interpretation of game progress and the end results of the draw. The video screen graphics may be made clearer and less cluttered, to enhance visual presentation. In addition, the present invention more easily accommodates the needs and desires of various players who may desire to make a different number of entries or selected a different number of gaming cards per gaming event.

Another feature of the present invention is that it speeds the processing of machine read game forms such as lottery tickets. Rather than processing multiple entry forms, only a single entry form needs to be scanned using the present invention. This saves considerable time for ticket attendants who must scan each form individually. Fewer forms or tickets also result in less wear and tear on the ticket reader and fewer ticket jams.

It will be recognized and appreciated by those of ordinary skill in the art that the present invention may be used to implement both primary games as well as secondary or bonus games. Further, the present invention may be used for effectuating multiple entries to a game played by an individual as well as for gaming involving groups of players, either at a common or in mutually remote locations.

It will also be understood by those of ordinary skill in the art that gaming spaces, or cells, may be of shapes other than rectangular. For example, it is contemplated that each cell may comprise a four-leaf clover, and each selection space may comprise one of the leaves. The center area of each clover may be used to display an identifier, such as a number. Selection of the number for a given entry may be indicated by illuminating that leaf. The leaves may be different colors to facilitate visual discrimination by a player. When the draw for the random game outcomes is made, as each number is drawn the center area of the clover may illuminate, optionally with some animation for emphasis. Each leaf in a clover which indicates it as part of a number selection by the player may also be illuminated, again with possible animation.

It is also contemplated that each selection space of a given set which maybe used to develop a single entry by a player may be represented by a different symbol within each gaming space, independent of their location within the gaming space. Thus, selection spaces of one set may be squares, of another may be circles, of a third, triangles, and of a fourth, stars. Different colors, as noted above, may be used to define different selection space sets.

Moreover, having thus described the invention, it should be apparent that numerous structural modifications and adaptations may be resorted to without departing from the scope and fair meaning of the instant invention as set forth above and as described by the claims.

What is claimed is:

1. A multiple game entry form comprising:

a plurality of gaming spaces, each gaming space having a unique indicator; and a plurality of selectable selection spaces associated with each of the gaming spaces, the number of selection spaces associated with each of the gaming spaces being fixed, a selection space associated with one of the gaming spaces together with a selection space from each of the other gaming spaces defining one of a plurality of separate game sets.

2. The multiple game entry form of claim 1, wherein the form is printed on a substrate.

3. The multiple game entry form of claim 2, wherein the form is in a computer-readable format.

4. The multiple game entry form of claim 1, wherein the form comprises an image displayed on a video screen display.

5. The multiple game entry form of claim 1, wherein the gaming spaces have a shape.

6. The multiple game entry form of claim 5, wherein the shape is a four-leaf clover.

7. The multiple game entry form of claim 5, wherein the shape is a square.

8. The multiple game entry form of claim 1, wherein the selection spaces have a shape.

9. The multiple game entry form of claim 8, wherein the shape is a four-leaf clover.

10. The multiple game entry form of claim 8, wherein the shape is a square.

11. A multiple game entry system comprising:

an entry form, the form having a plurality of gaming spaces, each gaming space having a unique indicator and a plurality of selectable selection spaces associated with each of the gaming spaces, the number of selection spaces associated with each of the gaming space being fixed, a selection space from each of the other gaming spaces defining one of a plurality of separate game sets;

an input element; and a controller, the controller programmed to process selection space selections from the input element.

12. The system of claim 11, wherein the entry form is a video screen display.

13. The system of claim 12, wherein the input element is at least one of the following: a touch sensitive video display screem, an element for indexing a cursor to a selected game space and its associated selection spaces, a key pad, a light pen, a mouse, or a joystick.

14. The system of claim 12, further comprising at least one indicia altering apparatus for a gaming event having a predetermined number of random outcomes, each random outcome corresponding to one gaming space, and the at least one indicia altering apparatus is configured for presenting each random outcome to a player by altering at least one displayed game space indicator for one of the gaming spaces.

15. The system of claim 14, further comprising at least one computation display area for displaying game statistics of the player.

16. The system of claim 11, further comprising at least one computation display area for displaying game statistics of a player.

17. A multiple game entry form comprising:

a plurality of gaming spaces, each gaming space having a plurality of corners and a unique indicator;

a selectable selection space disposed in each corner of each of the gaming spaces; and a selection space disposed in one of the corners of one of the gaming spaces together with a selection space disposed in one of the corners of each of the other gaming spaces defining one of a plurality of separate game sets.

18. The multiple game entry form of claim 17, wherein the form includes indicia printed on a substrate.

19. The multiple game entry form of claim 18, wherein the form is in a computer readable format.

20. The multiple game entry form of claim 17, wherein the form comprises an image displayed on a video screen display.

21. The multiple game entry form of claim 20, further comprising at least one computation display area for displaying game statistics of a player.

22. The multiple game entry form of claim 17, further comprising at least one computation display area for displaying game statistics of a player.

23. A multiple game entry form comprising:

a plurality of gaming spaces, each gaming space being in the shape of a square and including a unique indicator;

each gaming space having four selectable selection spaces;

a first selection space disposed in a first corner of each gaming space, the first selection spaces collectively defining a first game set;

a second selection space disposed in a second corner of each gaming space, the second selection spaces collectively defining a second game set;

a third selection space disposed in a third corner of each gaming space, the third selection spaces collectively defining a third game set; and a fourth selection space disposed in a fourth corner of each gaming space, the fourth selection spaces collectively defining a fourth game set.

24. The multiple game entry form of claim 23, wherein the form includes indicia printed on a substrate.

25. The multiple game entry form of claim 24, wherein the form is in a computer readable format.

26. The multiple game entry form of claim 23, wherein the form comprises an image displayed on a video screen display.

27. The multiple game entry form of claim 26, further comprising at least one computation display area for displaying game statistics of a player.

28. The multiple game entry form of claim 23, further comprising at least one computation display area for displaying game statistics of a player.

29. A multiple game entry form consisting of:

a plurality of gaming spaces, each gaming space being in the shape of a square and including a unique indicator;

a first selection space disposed in a corner of each gaming space, the first selection spaces collectively defining a first game set;

a second selection space disposed in a corner of each gaming space, the second selection spaces collectively defining a second game set;

a third selection space disposed in a corner of each gaming space, the third selection spaces collectively defining a third game set; and a fourth selection space disposed in a corner of each gaming space, the fourth selection spaces collectively defining a fourth game set.

* * * * *

UNITED STATES PATENT AND TRADEMARK OFFICE

CERTIFICATE OF CORRECTION

PATENT NO. : 6,840,859,B2
DATED : January 11, 2005
INVENTOR(S) : Lee E. Cannon et al.

It is certified that error appears in the above-identified patent and that said Letters Patent is hereby corrected as shown below:

Column 10,
Line 40, cancel "space" and insert -- spaces --.
Line 41, cancel "space from" and insert -- space associated with one of the gaming spaces together with a selection space from --.
Line 51, cancel "screem," and insert -- screen --.

Signed and Sealed this

Fifth Day of July, 2005

JON W. DUDAS
*Director of the United States Patent and Trademark Office*